US006318230B1

(12) United States Patent
Bamber

(10) Patent No.: US 6,318,230 B1
(45) Date of Patent: Nov. 20, 2001

(54) GUN ATTACHMENT

(75) Inventor: Craig Anderson Bamber, Wanganui (NZ)

(73) Assignee: Ordnance Developments Limited, Wanganui (NL)

( * ) Notice: Subject to any disclaimer, the term of this patent is extended or adjusted under 35 U.S.C. 154(b) by 0 days.

(21) Appl. No.: 09/466,184

(22) Filed: Dec. 17, 1999

(30) Foreign Application Priority Data

Dec. 20, 1998 (NZ) ..... 332808

(51) Int. Cl.[7] ..... F41A 21/26
(52) U.S. Cl. ..... 89/14.5; 89/29; 42/77
(58) Field of Search ..... 89/14.5, 29; 42/77

(56) References Cited

U.S. PATENT DOCUMENTS 2,714,332 * 8/1955 Saetter-Lassen ..... 89/14.5
3,363,509 * 1/1968 Tschoepe ..... 89/14.5
3,369,453 * 2/1968 Menneking et al. ..... 89/14.5
4,128,040 * 12/1978 Schuetz ..... 89/14.5
4,685,378 * 8/1987 Lusk et al. ..... 89/14.5
5,140,893 * 8/1992 Leiter ..... 89/14.5
5,438,907 * 8/1995 Reynolds et al. ..... 89/14.5

* cited by examiner

*Primary Examiner*—J. Woodrow Eldred
(74) *Attorney, Agent, or Firm*—Young & Thompson

(57) ABSTRACT

A blank firing attachment for a recoil operated gun. The attachment comprises a barrel (10) having in its length an external shoulder (12). A gas cylinder in the form of a sleeve (13) is slidingly fitted onto the barrel (10) and located over the external shoulder (12). An internal shoulder (14) of the sleeve is located opposite the external shoulder (12) such that the shoulders (12 and 14) together with the surface of the barrel (10) and the sleeve (13) form a gas chamber (24). At least one gas transfer passage (11) connects the gas chamber (24) to the bore (10') of the barrel (10). A mounting flange (15) with fastenings (19) and locking lugs (20) fix the gas cylinder (13) to a receiver section (23) of a gun.

26 Claims, 6 Drawing Sheets

GUN ATTACHMENT

BACKGROUND OF THE INVENTION

This invention relates to a blank firing attachment for a recoil operated gun.

Recoil operated machine guns using the well known Browning short recoil principle rely on the recoil generated by the expulsion of a standard projectile to generate the forces required to operate the machine gun mechanism. When the gun is required to fire blanks a problem arises if the gun is to function in the fully automatic fire mode. As there is no projectile propelled along the barrel of the gun and the blank cartridge typically only has a small charge of fast powder to provide a loud report there is therefore very little recoil generated.

Accordingly it is known to provide a blank firing attachment which when mounted on a recoil operated machine gun provides a simulation of the recoil which would normally be generated when shooting live ammunition. The attachment therefore results in the automatic mechanism of the gun operating in a normal manner even though blank ammunition is being used.

Such attachments, however, have suffered from a variety of problems ranging from difficulty of installation to unreliability in use. Many of these problems arise from the attachments being of complex construction which requires a high level of maintenance, especially when the attachment is in use, to ensure correct and reliable operation.

SUMMARY OF THE INVENTION

The object of the present invention is thus to provide a blank firing attachment for a recoil operated gun, the attachment being of simple yet rugged construction.

Broadly the invention consists of a blank firing attachment for a recoil operated gun the attachment comprising a barrel having in its length an external shoulder, a gas cylinder in the form of a sleeve, said sleeve being slidingly fitted onto the barrel and located over the external shoulder such that the internal and external shoulders are located opposite one another and spaced apart, said sleeve, shoulders and surface of the barrel forming a gas chamber, there being at least one gas transfer passage in the barrel connecting said gas chamber to the bore of the barrel and fixing means adapted to fix the gas cylinder to the receiver section of the gun.

DESCRIPTION OF THE PREFERRED EMBODIMENTS

The blank firing attachment according to the present invention is in the illustrated embodiment intended for use with 0.50 calibre Browning M2 and QCB heavy machine guns. The blank firing attachment permits such guns to operate in full automatic firing mode using blank ammunition.

Figure 2:
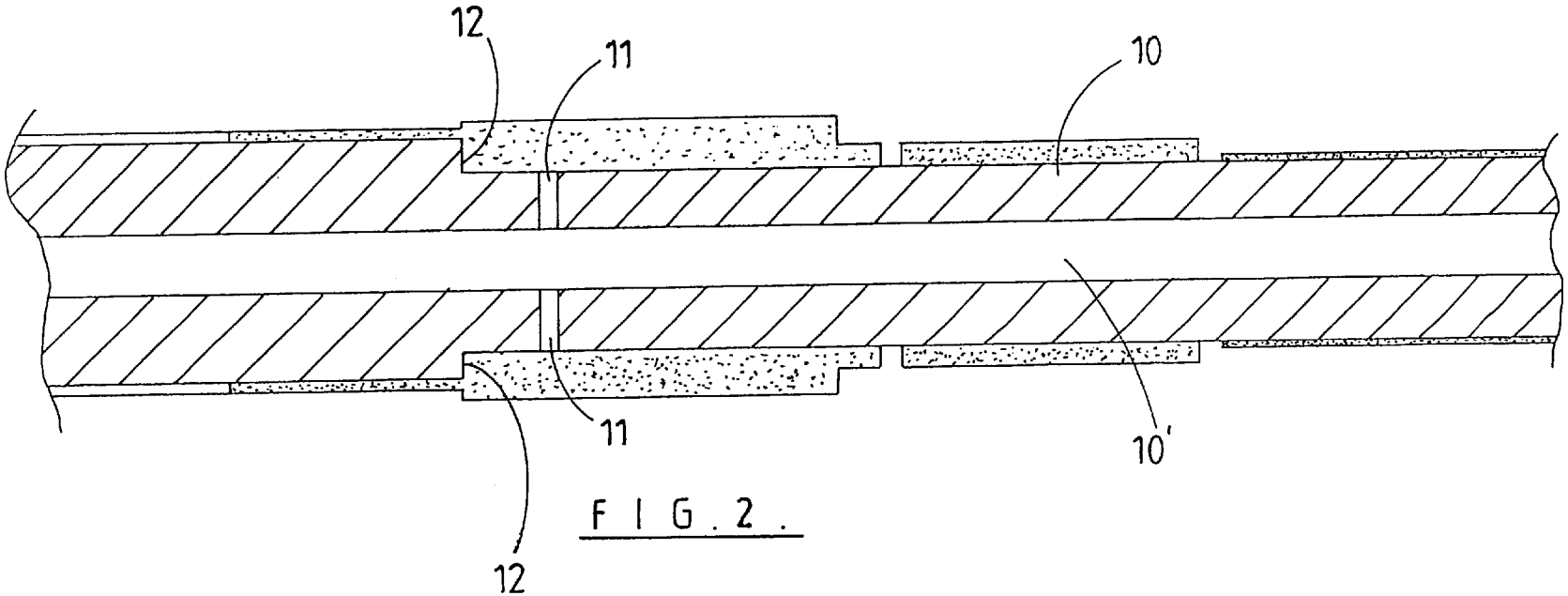
FIG. 2 is a section view of a barrel of an M2 Browning machine gun prior to adaption thereof to form part of the attachment according to the present invention.

The attachment is based on the barrel 10 of a Browning M2 as illustrated in FIG. 2. Generally a barrel which has been used to the point of not being suitable for live ammunition firing is employed. To adapt the barrel 10 the shaded areas indicated in FIG. 2 are removed from the barrel 10 by a simple lathe turning operation. Subsequent to this diametrically opposed gas transfer ports or passageways 11 are formed in the barrel 10. Transfer passages 11 are located adjacent an external shoulder 12 formed in the external periphery of barrel 10 during the aforementioned lathe turning operation.

Figure 1:
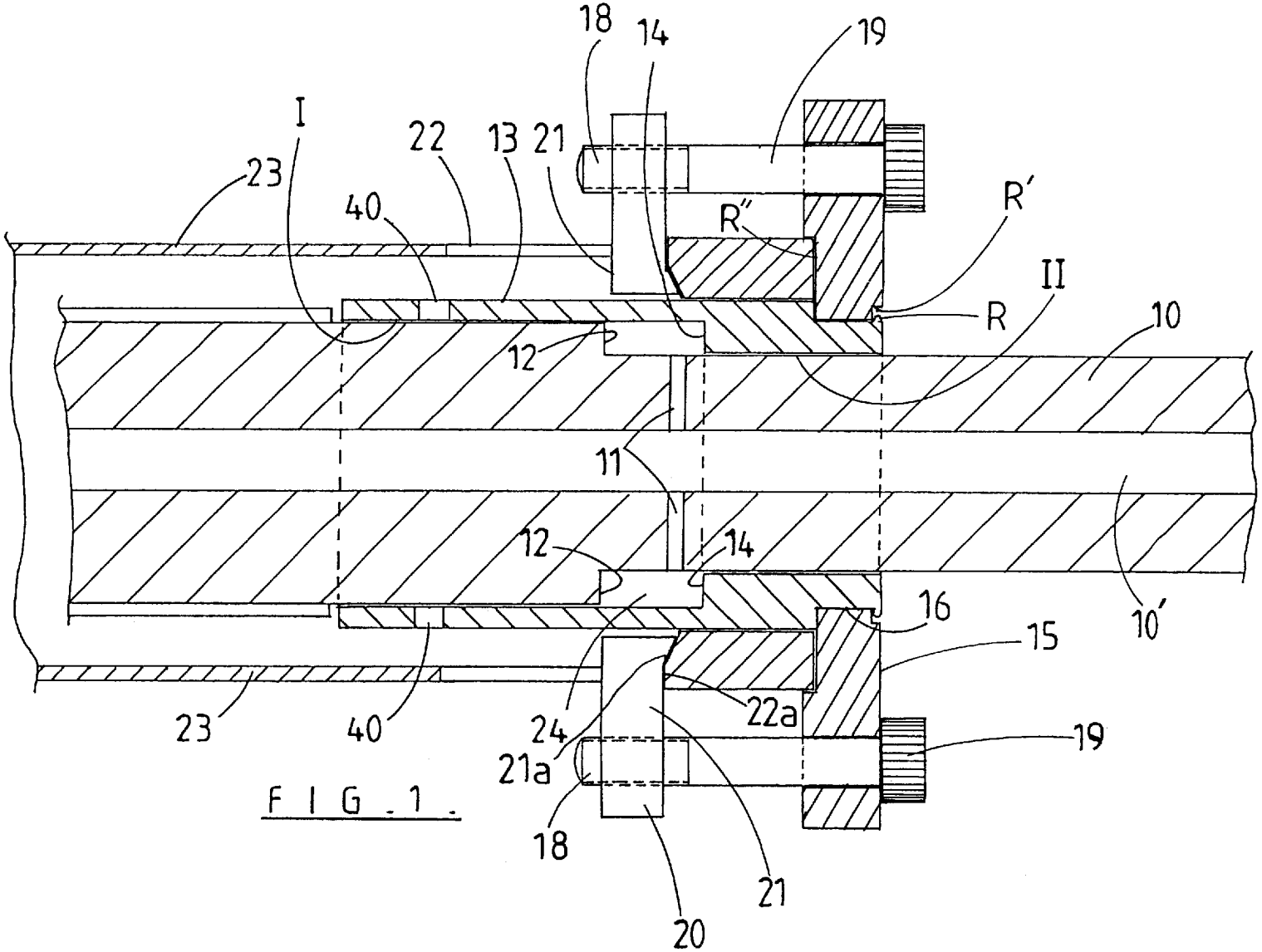
FIG. 1 is a cross-sectional view showing part of the attachment mounted with the barrel support shroud of the receiver section of a gun.

A gas cylinder 13 in the form of a sleeve having an internal shoulder 14 is located on the barrel 10 as shown in FIG. 1. A gas cylinder flange 15 is mounted with and fastened via a stepped portion 16 at one end of the gas cylinder 13. As illustrated shoulder 14 is formed by gas cylinder 13 having internal walls of two different diameters. These two diameters correspond to the different diameters of the barrel 10 which create external shoulder 12. As can be seen in FIG. 1, the shoulders 12 and 14 are oppositely disposed. Thus gas cylinder 13 is a snug yet sliding fit on barrel 10.

A clearance in the area I (see FIG. 1) and a clearance in the area II is provided. The clearance at area I is smaller than that at area II. The tolerances are wide enough to provide for the build up of a layer of carbon to create a sliding surface for the gas cylinder 13 to slide on the barrel 10.

Figure 4:
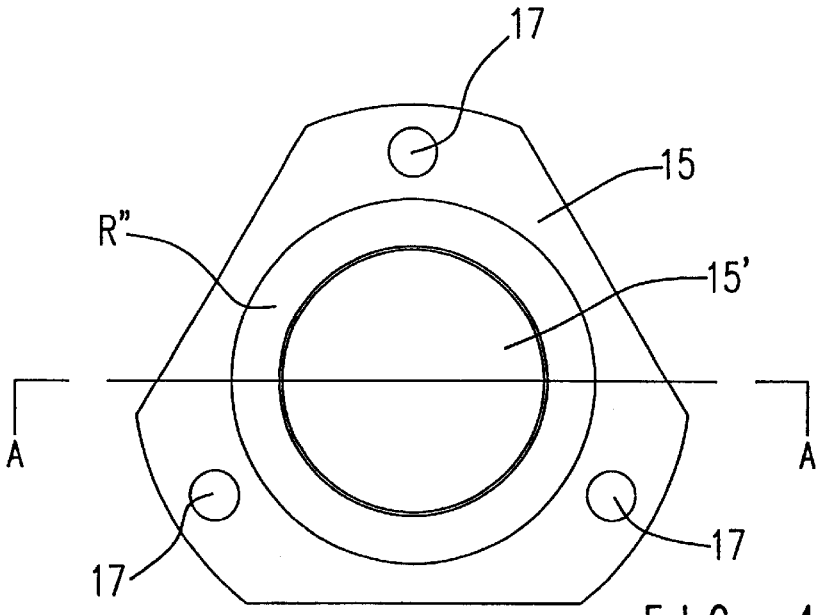
FIG. 4 is an elevation view of the gas cylinder flange of the attachment.

Flange 15 is formed, see FIG. 4, with a plurality of spaced apart openings 17 through which the threaded shanks 18 of cap screws 19 are located. A locking lug 20 is applied to the threaded end 18 of each screw 19.

As illustrated in FIG. 1 (in a somewhat schematic form as explained later) the free end portion 21 of each locking lug 20 engages within an opening 22 in the barrel support shroud 23 of the receiver section of the gun. Preferably the free end portion 21 is angled rearwardly (at 21*a*) to engage with sloping return of edge 22*a* of opening 22 as illustrated for a more positive engagement. Thus flange 15 can be tightened hard up against the extreme end of shroud 23 by the tightening of cap screws 19. Gas cylinder 13 thus becomes a fixture with the receiver section of the gun.

As can be seen in FIG. 1, the screws 19 are spaced away from the shroud 23. Thus, as the screws 19 are tightened, the end portions 21 of locking lugs 20 are not only drawn into clamping contact with the edge 22*a* of the opening 22 in the shroud 23 but a slight inclination of the length of the locking lug relative to shank 18 occurs thereby applying a side torque. This results in binding between the shank 18 and lug 20.

While a lock nut (not shown) can and would normally be applied to the exposed end of the thread of shank 18, this is not necessary as the binding prevents the screw 19 and locking lug 20 loosening. Therefore, if a locking nut is used and works loose the locking lug 20 will still be held in place by the screw 19.

Figure 5:
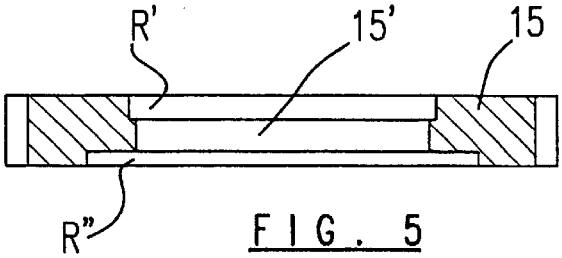
FIG. 5 is a cross-sectioned view of the gas cylinder flange of FIG. 4, FIGS. 6 to 8 are orthogonal views of an example of a shroud locking lug.

Preferably step 16 has at or near its outer end a retaining rib or projection R. A corresponding recess R' is formed in the peripheral edge of the central opening 15' in flange 15 (see FIG. 5). Thus flange 15 can be heat expanded so that the central opening 15' of the flange can pass over the retaining rib or projection R of step 16. The flange contracts on cooling and is retained in place by the rib R in recess R' in a somewhat slack and sloppy fit.

Thus the flange 15 is self aligning when tightened up against the end of shroud 23. This allows for any alignment and binding problems which may otherwise arise.

The flange 15 has on the side opposite to recess R' a second recess R" of larger diameter. The recess R" engages over the end of the barrel support shroud 23 and ensures proper alignment of the gas cylinder 13 with the barrel support shroud 23. Also, it prevents binding of parts as the locking screws 19/locking lugs 20 are tightened as described above.

Figure 6:
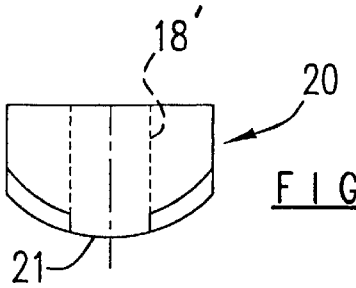
Figure 7:
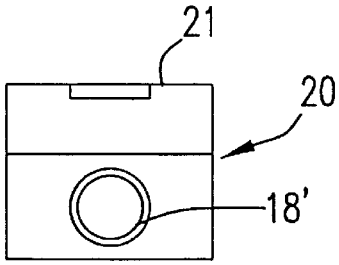
Figure 8:
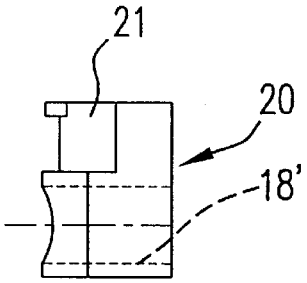

According to commercial forms of the invention, different shapes and configurations of locking lugs 20 will be provided to suit the particular openings in the barrel support shroud 23 of different guns. For example, in FIGS. 6 to 8 there is shown views of a locking lug intended for a Browning FNQCB. By having locking lugs designed to suit a particular gun shroud nearly complete surface contact between locking lug and shroud can be assured. The end result is not only a good locking effect but also prevention of damage.

External shoulder 12, internal shoulder 14, the surface of barrel 10 therebetween and the internal wall surface of gas cylinder 13 between shoulders 12 and 14 define a gas chamber 24. Thus upon a blank being discharged gas enters chamber 24 via transfer ports 11. The expansion of gas in chamber 24 causes a reaction between shoulders 12 and 14. Due to shoulder 14 being fixed this reaction causes shoulder 12 to move away thereby providing the recoil reaction in the barrel necessary to operate the machine gun mechanism.

Gas cylinder 13 also includes at least one gas exhaust hole 40 (see FIG. 1). This allows for scavenging of spent gas from enlarged gas chamber 24.

Figure 3:
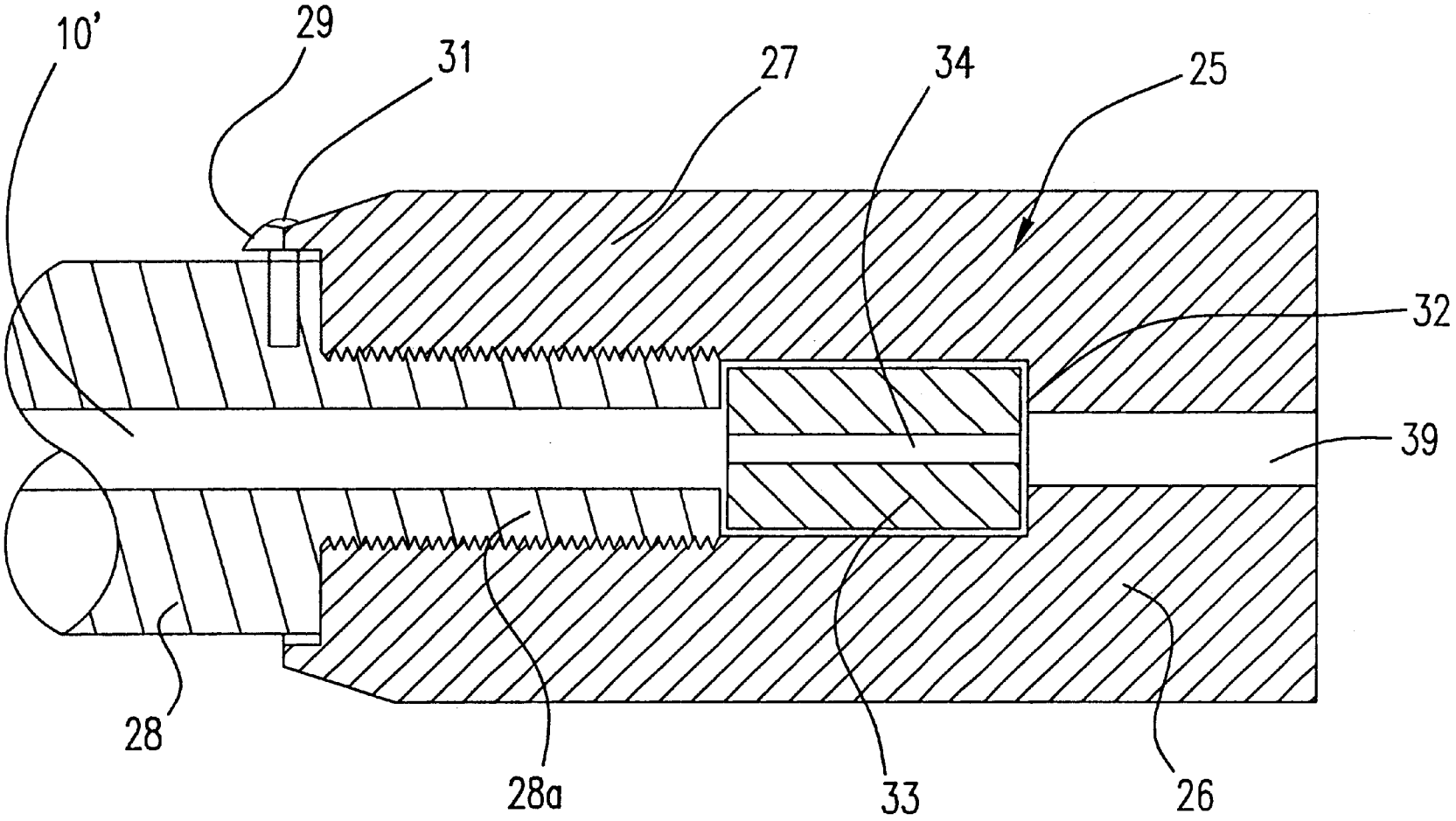
FIG. 3 is a section view of the muzzle end of the barrel of the attachment showing a gas restrictor located therein.

The blank firing attachment preferably further includes a gas restrictor 25 fitted to the muzzle 28 of the barrel (see FIG. 3). According to one form of the invention this gas restrictor 25 comprises an attachment 26 which has a threaded portion 27 which enables the insert to be threaded onto a threaded end 28*a* of muzzle 28. Threaded end 28*a* is formed by the end of the muzzle being turned down and a thread applied thereto.

Projecting beyond the threaded portion 27 of restrictor 25 is an extension piece 29 which engages over that part of muzzle 28 adjacent the turned down portion 28*a*. A cap screw 31 engages through the extension piece 29 and into a tapped hole in muzzle 28. This attachment of the extension piece 29 to the muzzle 28 prevents attachment 26 from turning on the muzzle 28.

Emission of gas from the bore 10' of barrel 10 upon discharge of the gun takes place via bore 39 in the end of attachment 26. Located in a chamber 32 in attachment 26 and thus located between the bore 10' and 39) is a replaceable gas restricting plug 33. A bore 34 which is coaxial with bores 10' and 39 extends through plug 33. As bore 34 is of less cross-sectional area than the bore 10' a back pressure is created. By being replaceable plugs 33 having different vent sizes (ie diameter of bore 34) can be used.

Referring now to FIGS. 9–12, there is shown an alternative gas restrictor arrangement at the muzzle 28 of the barrel 10. According to this form of the invention the muzzle end 28 is formed with counter bores 41 and 42 which are coaxial with bore 10'. Counter bore 41 is of greater diameter and is internally threaded. A transversely disposed relief hole 43 opens from bore 42 to the exterior of the barrel.

The muzzle end of the barrel 10 is profiled to receive a flat spring member 44. An opening 45 is provided to receive a threaded fastener to mount the fixed end 46 of the spring member 44. At the extreme end of the barrel 10 a pair of raised lugs 47 are provided in between which the spring 44 fits. These lugs 47 thus ensure the spring is correctly aligned.

The profile of the muzzle end also includes a recess 48 which results in a gap being formed under the spring member 44 so as to prevent overheating of the spring.

Figure 11:
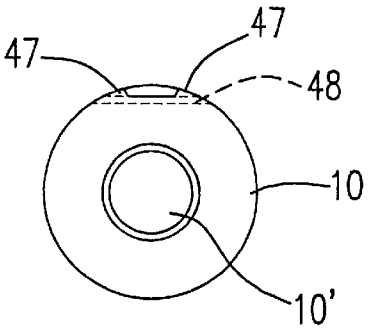
FIG. 11 is an end elevation view of the arrangement of FIGS. 9 and 10.
Figure 9:
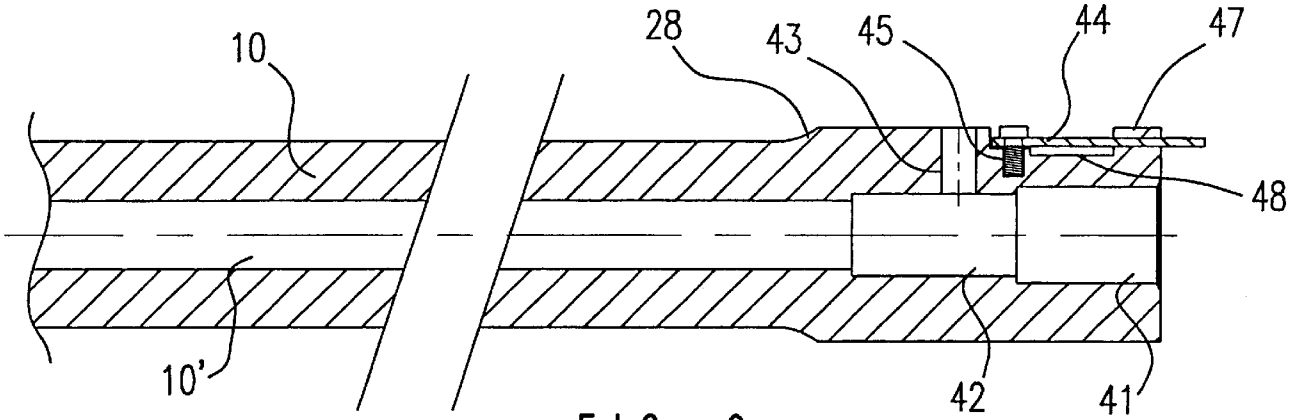
FIGS. 9 is a cross-sectional elevation of the muzzle of the gun barrel adapted to receive a gas restrictor according to a second form.
Figure 10:
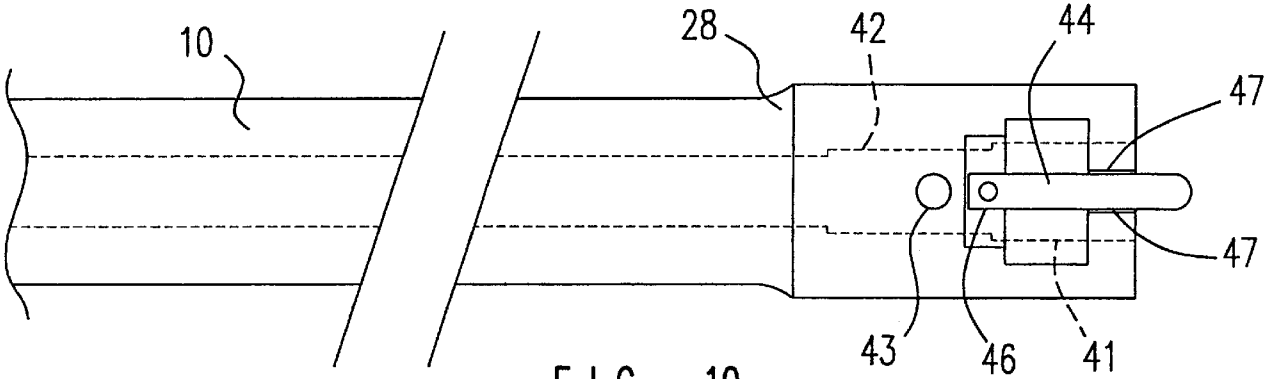
FIG. 10 is a plan view of the arrangement of FIG. 9.
Figure 13:
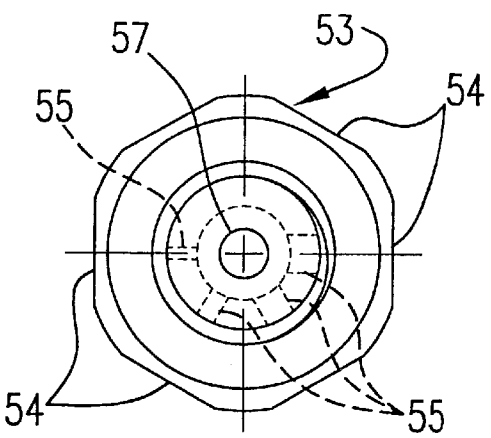
FIG. 13 is an end view of the restrictor of FIG. 11.
Figure 12:
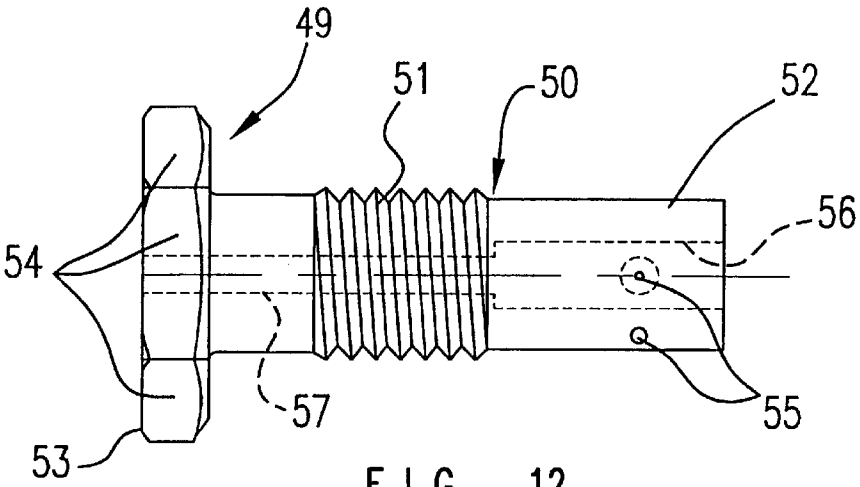
FIG. 12 is an elevation view of the gas restrictor to fit into the arrangement of FIGS. 9 and 10.
Figure 14:
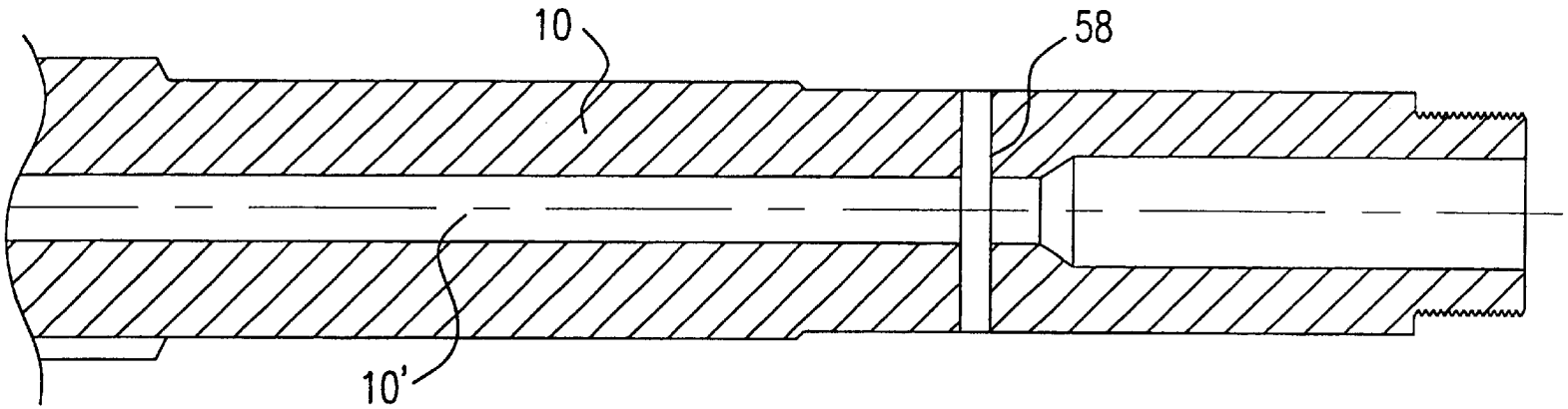
FIG. 14 is a cross-sectional view of the barrel of a gun with a safety fitting to prevent chambering of live ammunition.

As shown in FIGS. 11 and 12, a gas restrictor 49 has a stepped shank 50 of two diameters, one diameter which is the larger being formed with a thread 51 and therefore engageable in threaded counterbore 41. The lesser diameter portion 52 is of a diameter such that it is a relatively snug fit within counterbore 42. A head 53 is provided with flats 54.

A series of small holes or ports 55 are formed in the smaller diameter distal portion 52 of the gas restrictor 49, these holes being of different sizes and aligned one with each of the flats 54 on head 53.

A bore 56 extends through the distal end portion 52 and is coaxial with the bore 10'. This bore 56 opens into a smaller diameter bore 57 which extends through the remainder of the gas restrictor 49 to open through head 53, The gas restrictor 49 can thus be rotated such that a selected one of bores 55 becomes aligned with relief hole 43. Accordingly, as with the first described gas restrictor arrangement the extended back pressure can be adjusted though in a more simple manner than the replacement of the plugs 33 of the first described embodiment.

The blank firing attachment according to the present invention is of simple yet robust construction. Its manufacture does not require the complex manufacturing techniques required with known blank firing attachments nor does it use a variety of welded parts and fragile components as is the case with known attachments. Not only do the multiplicity of parts of the known attachments require correct assembly but these parts are easily lost if the attachment is taken apart in the field.

A safety feature is provided by the external diameter of the muzzle extension piece or restrictor 25 being greater than the gas cylinder 13. Thus, in the event of a gas cylinder 13 being propelled forward, it will not leave the barrel 10 and hence exit the gun.

An additional safety feature to be used in association with the blank firing attachment according to the present invention is the insertion of a pin 58 extending transversely across the barrel 10 and through the bore 10' of the barrel. This pin is therefore located just forward of the blank mouth and positioned such that it prevents live ammunition from chambering and firing.

The present invention provides an attachment which is simple to install and overcomes the difficulties associated with known attachments. Furthermore installation is not that detailed as to require installation by a skilled armourer. Still further the present attachment does not suffer from adjustments mechanisms and retainers which "shoot loose" after sustained fire in the field.

What is claimed is:

1. A blank firing attachment for a recoil operated gun, the attachment comprising a barrel with an internal bore, the barrel having in its length an external shoulder, a gas cylinder in the form of a sleeve slidingly fitted onto the barrel and located over the external shoulder, the sleeve incorporating an internal shoulder which is located opposite and spaced from said external shoulder, a gas chamber formed by said sleeve, internal shoulder, external shoulder and surface of the barrel, at least one gas transfer passage in the barrel connecting said gas chamber to the internal bore, and a fixing device having anchors which are engageable with a receiver section of a gun to fix the gas cylinder to the gun.

2. The attachment of claim 1 wherein the fixing device includes a flange mounted with the gas cylinder.

3. The attachment of claim 2 wherein the flange is mounted to the gas cylinder by a self-aligning mount.

4. The attachment of claim 2 wherein the flange has a series of openings, each anchor being in the form of a mechanical fastener engaged through a respective one of said openings, each fastener being coupled to a locking member, the locking member having a gun receiver engagement portion.

5. The attachment of claim 4 wherein the locking member is threaded onto a threaded end of the fastener.

6. The attachment of claim 5 wherein the fastener has a longitudinal axis spaced from, in use, the point of contact of the locking member engagement section and said gun receiver section.

7. The attachment of claim 1 wherein a first clearance is provided between the sleeve and that part of the barrel which extends rearwardly, relative to the muzzle end of the barrel, from the external shoulder.

8. The attachment of claim 7 wherein at least one gas exhaust port extends through the sleeve to communicate with said first clearance.

9. The attachment of claim 8 wherein a second clearance is formed between the sleeve and a port of the barrel which is located forward, relative to the muzzle end of the barrel, of the external shoulder.

10. The attachment of claim 9 wherein the first clearance is less than the second clearance.

11. The attachment of claim 1 further including a gas restrictor device mountable at the muzzle end of the gun barrel.

12. The attachment of claim 11 wherein the gas restrictor includes a removable plug which has a bore of less diameter than that of the gun barrel at the muzzle end.

13. The attachment of claim 12 wherein the removable plug is located within a casing which is removably attached to the muzzle end, said casing having a bore which is coaxial with the bores of the plug and the barrel.

14. The attachment of claim 13 wherein the casing is screwed onto the muzzle end and locked against rotation by a locking fixture.

15. A blank firing attachment for a recoil operated gun, the attachment comprising a barrel with an internal bore, the barrel having in its length an external shoulder, a gas cylinder in the form of a sleeve slidingly fitted onto the barrel and located over the external shoulder, the sleeve incorporating an internal shoulder which is located opposite and spaced from said external shoulder, a gas chamber formed by said sleeve, internal shoulder, external shoulder and surface of the barrel, at least one gas transfer passage in the barrel connecting said gas chamber to the internal bore, a fixing device having anchors which are engageable with a receiver section of a gun to fix the gas cylinder to the gun, and a gas restrictor device mountable at a muzzle end of the gun barrel, wherein the gas restrictor includes a pair of counter bores at the muzzle end of the barrel and a restrictor plug screw threaded into one of said counterbores, the restrictor plug having a portion which locates in the other of said counterbores, the restrictor plug having a passageway coaxial with the bore of the barrel, at least one transfer port leading from the passageway communicating with a relief hole in the barrel.

16. The attachment of claim 15 further including an indexing mechanism whereby the restrictor plug can be rotatably adjusted to locate a selected one of a plurality of transfer ports with said relief hole.

17. The attachment of claim 16 wherein the indexing mechanism includes a spring element mounted with the barrel and engaging with one of a series of engagement surfaces of said restrictor plug.

18. The attachment of claim 17 further including a clearance between the spring element and the barrel.

19. A recoil operated gun incorporating a blank firing attachment as claimed in claim 1.

20. A gun as claimed in claim 19 further including a restrictor associated with the gun barrel at the breach end, the restrictor being positioned adjacent the blank mouth to prevent live ammunition from being chambered.

21. A recoil operated gun incorporating a blank firing attachment as claimed in claim 11.

22. A recoil operated gun incorporating the blank firing attachment of claim 15.

23. A blank firing attachment for a recoil operated gun, the attachment comprising:

a barrel with an internal bore and an external surface that has an annular shoulder spaced from an end of said barrel;

a sleeve slidingly arranged on said barrel over said annular shoulder, said sleeve having an internal shoulder opposite said annular shoulder;

a gas chamber defined by said internal shoulder, said annular shoulder, said external surface of said barrel, and an internal surface of said sleeve;

a gas transfer passage extending transversely through said barrel from said internal bore to said external surface of said barrel that defines said gas chamber; and anchors that are adapted to attach said sleeve to a receiver section of a gun.

24. The attachment of claim 23, wherein said gas transfer passage is generally perpendicular to a longitudinal axis of said barrel.

25. The attachment of claim 1, wherein said gas transfer passage extends transversely through said barrel.

26. The attachment of claim 1, wherein said external shoulder is spaced from an end of said barrel.

* * * * *